US011330849B2

(12) United States Patent
Bastug et al.

(10) Patent No.: US 11,330,849 B2
(45) **Date of Patent: *May 17, 2022**

(54) SUSTAINABLE BRA GARMENT AND IMPROVED BIO-BASED PAD PORTIONS

(71) Applicant: Gelmart Industries, Inc., New York, NY (US)

(72) Inventors: Eve Bastug, North Haledon, NJ (US); Yoseph Nasser, New York, NY (US)

(73) Assignee: Gelmart Industries, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/329,790

(22) Filed: May 25, 2021

(65) Prior Publication Data

US 2022/0061411 A1 Mar. 3, 2022

Related U.S. Application Data

(63) Continuation-in-part of application No. 17/009,133, filed on Sep. 1, 2020.

(51) Int. Cl.
*A41C 3/14* (2006.01)
*A41C 3/10* (2006.01)

(52) U.S. Cl.
CPC ..... *A41C 3/144* (2013.01); *A41C 3/10* (2013.01)

(58) Field of Classification Search
CPC ..... A41C 3/144; A41C 3/10; C08L 23/08
USPC ..... 450/1, 54–57
See application file for complete search history.

(56) References Cited

U.S. PATENT DOCUMENTS

| | | | | |
|---|---|---|---|---|
| 8,240,174 | B2 | 8/2012 | Soeda | |
| 8,696,643 | B2 | 4/2014 | Knightingale | |
| 8,956,199 | B2 * | 2/2015 | Liu | A41C 3/146 450/38 |
| 9,788,578 | B2 | 10/2017 | Betts | |
| 9,961,946 | B2 | 3/2018 | Calhoun | |
| 2005/0075048 | A1 * | 4/2005 | Legaspi | A41C 3/10 450/41 |
| 2009/0311943 | A1 * | 12/2009 | Mone | A41C 3/10 450/38 |
| 2010/0319409 | A1 * | 12/2010 | Soeda | D04B 21/16 66/176 |
| 2013/0165017 | A1 * | 6/2013 | Liu | A41C 3/146 450/38 |

(Continued)

*Primary Examiner* — Gloria M Hale
(74) *Attorney, Agent, or Firm* — GS2Law LLP

(57) ABSTRACT

A sustainable bra garment that includes first and second cup portions that are formed of one or more recycled flexible materials and first and second side wing panels that extend from the first and second cup portions, respectively, and having first and second cushioning support pads formed of a bio-based foam material that is biodegradable and/or recyclable. First and second cushioning support pads are configured to be coupled with the first and second cup portions, respectively. Each of the pads is formed of an eco-friendly sustainable material, such as a sugar cane-based polymer foam material, that has hardness and density values that provide both cushioning and support to breasts of a wearer of the sustainable bra garment. The cushioning support pads may be used with a bra garment or with other garments such as swimwear and other apparel where bra support pads can be incorporated.

12 Claims, 6 Drawing Sheets

(56) References Cited

U.S. PATENT DOCUMENTS

| | | | | |
|---|---|---|---|---|
| 2016/0045841 | A1* | 2/2016 | Kaplan | B01D 53/48 429/49 |
| 2018/0084841 | A1* | 3/2018 | Calhoun | A41C 3/144 |
| 2019/0261699 | A1 | 8/2019 | Rushton | |
| 2019/0315948 | A1* | 10/2019 | Delevati | C07C 1/24 |
| 2020/0229513 | A1 | 7/2020 | Dowdle | |
| 2021/0070956 | A1* | 3/2021 | Delevati | C08J 9/0061 |

* cited by examiner

SUSTAINABLE BRA GARMENT AND IMPROVED BIO-BASED PAD PORTIONS

BACKGROUND

The present application is a continuation-in-part of U.S. application Ser. No. 17/009,133 filed on Sep. 1, 2020. This disclosure relates generally to a bra garment and more particularly to bra garment formed of sustainable materials, including improved bra pad portions formed of bio-based polymeric foam materials, that as contrasted with petroleum-based foam pad materials, are recyclable, biodegradable and/or environmentally sustainable.

Bras are commonly worn by women to provide support for their breasts and for enhanced shape and appearance. Other garments have built-in bras and can provide the same function. Proper support for the wearer is important for bras and thus dictates the type of materials that can be used, particularly for the pads of the bra used for shaping and support as desired, which are typically formed of petroleum-based polymeric foams that are not recyclable or biodegradable. As such, foam pads are usually attached to the bra using a glue. The foam material and glue, however, can be toxic to the wearer and is not recyclable or environmentally friendly. There is therefore a need for improved environmentally friendly bra garments, particularly bra garments having foam pad portions formed of recyclable and biodegradable materials to make bra products more environmentally friendly and sustainable. The improved recyclable and biodegradable support pads of the present invention may be used with a bra garment or with other garments such as swimwear and other apparel where bra support pads can be incorporated.

SUMMARY

The present disclosure may provide a sustainable bra garment that comprises first and second cup portions that include bra pad portions formed of one or more bio-based polymeric foam materials and first and second side wing panels that are formed of recycled flexible materials and extend from the first and second cup portions, respectively. First and second cushioning support pads are configured to be coupled with the first and second cup portions, respectively. Each of the bra pad portions has front and back surfaces wherein the front surface of each pad that has a generally convex shape and the back surface of each pad that has a generally concave shape. Each of the pads is formed of a sustainable material that has hardness and density values that provide both cushioning and support to breasts of a wearer of the sustainable bra garment. The pads formed of a sustainable material may also be used within other types of garments and apparel, such as sports bras, swimwear, camisoles, bustiers and other apparel where bra support pads can be incorporated.

In certain embodiments, the sustainable material is a bio-based material, such as a sugar cane-based polymeric foam material (known in the art as a "green-EVA" material) that is non-toxic to the wearer. The sustainable material is formed with biodegradable materials and with an environment-friendly process; each pad can also be devoid of a lamination or glue layer on at least the back surface thereof; the one or more recycled materials of the first and second cup portions and the first and second side wing panels is one or more recycled fabrics; and/or the first and second cup portions and the first and second side wing panels are formed of the same recycled fabric.

In other embodiments, the bra garment further comprises elastic shoulder straps attached between the first cup portion and the first side wing panel and between the second cup portion and the second side wing panel, respectively, and the elastic shoulder straps are formed of recycled materials; each of the shoulder straps include an adjustable element for adjusting the length of the shoulder straps, the adjustable element is formed of a sustainable material that has a hardness value that is greater than the hardness value of the sustainable material of the pads; each of the first and second cup portions has an underwire channel; the bra garment of claim 1, further comprising a bridge panel that joins the first and second cup portions, and the bridge panel is formed of a recycled material; and/or the free ends of the first and second side wings panels include corresponding clasp elements for clasping the free ends together.

The present disclosure may also provide a sustainable bra garment that comprises first and second cup portions that are formed of one or more recycled fabrics. Each of the first and second cup portions has an outer piece and an inner piece. The inner and outer pieces are attached to one another at respective perimeters thereof forming a pad receiving area therebetween. First and second side wing panels extend from the first and second cup portions, respectively. The first and second side wing panels are formed of one or more recycled fabrics. First and second cushioning support pads are retained in the receiving areas of the first and second cup portions, respectively. Each of the pads has front and back surfaces that correspond to the outer and inner pieces of the first and second cup portions, respectively. The front surface of each pad has a generally convex shape and the back surface of each pad has a generally concave shape. Each of the pads is formed of only a sustainable material that has hardness and density values that provide both cushioning and support to breasts of a wearer of the sustainable bra garment. The sustainable material is a biobased material that is non-toxic to the wearer.

In some preferred embodiments, environmentally friendly pad portions can be manufactured by a sustainable and environment-friendly process using sugar cane-based polymeric foam materials known in the art as Green or bio-based EVA materials. Bio-based EVA materials are known in the art and have been developed and used previously for the production of the soles of certain specialty footwear products [See https://www.forbes.com/sites/veenamccoole/2018/08/01/allbirds-launches-flip-flops-made-from-sustainable-sugarcane/?sh=55cd98913672 and https://materialdistrict.com/article/flip-flops-sugarcane-foam/]. However, in the present invention it has been found that a bio-based EVA material can be more specifically formulated and processed to produce a softer and yet structurally sound foam polymer material appropriate for use as an eco-friendly bra pad. In the present invention, preferred polymerization and foaming methods are disclosed for use in forming molded bra pad products from bio-based EVA's, that have the flexibility and structural qualities of petroleum-based EVA's, but that are biodegradable and/or recyclable after the useful life of the pad is reached for a typical bra pad product. Also the outer piece of each cup portion may be formed of a recycled nylon and the inner piece of each cup portion is formed of recycled polyester; the bra garment further comprises elastic shoulder straps attached between the first cup portion and the first side wing panel and between the second cup portion and the second side wing panel, respectively, and the elastic shoulder straps are formed of recycled fabric; and/or each of the first and second cup portions has an underwire channel and a bridge panel joins the first and second cup portions, and both the underwire channel and the bridge panel are formed of a recycled material.

The present disclosure may yet further provide a sustainable bra garment that comprises first and second cup portions. Each of the first and second cup portions has an outer piece and an inner piece. The inner and outer pieces are attached to one another at respective perimeters thereof forming a pad receiving area therebetween. The inner and outer pieces are formed of one or more recycled fabrics. The first and second side wing panels extend from the first and second cup portions, respectively. The first and second side wing panels are formed of one or more recycled fabrics. First and second cushioning support pads are retained in the receiving areas of the first and second cup portions, respectively. Each of the pads has front and back surfaces that correspond to the outer and inner pieces of the first and second cup portions, respectively. The front surface of each pad has a generally convex shape and the back surface of each pad has a generally concave shape. As disclosed herein each of the pads is formed of a sustainable material that is a biobased foam polymer with hardness and density values that provide both cushioning and support to breasts of a wearer of the sustainable bra garment, and that is non-toxic to the wearer. Substantially, each portion of the sustainable bra garment is formed of either recycled or sustainable materials.

In certain embodiments, the sustainable material can be manufactured by a sustainable and environment-friendly process; the bra garment further comprises elastic shoulder straps attached between the first cup portion and the first side wing panel and between the second cup portion and the second side wing panel, respectively, and the elastic shoulder straps are formed of recycled fabric; each of the shoulder straps include an adjustable element for adjusting the length of the shoulder straps, the adjustable element being formed of a sustainable material that has a hardness value that is greater than the hardness value of the sustainable material of the pads; and/or each of the first and second cup portions has an underwire channel and a bridge panel joins the first and second cup portions, and the free ends of the first and second side wings panels include corresponding clasp elements for clasping the free ends together, wherein the underwire channel, the bridge panel, and the clasping elements are formed of recycled materials.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Referring to the figures, the present disclosure generally relates to a bra garment 100 formed of sustainable and recycled materials that is environmentally friendly, non-toxic to the wearer to promote health and wellness, and can be manufactured at a reduced cost. The bra garment 100 may be, for example a bra, sports bra, a maternity bra, a brassier, a bikini top, a camisole, other lingerie top, or other breast covering garment, such as swimwear.

The bra garment 100 may generally comprise cup portions 102*a*, 102*b*, side wing panels 104*a*, 104*b* extending from the respective cup portions 102*a*, 102*b*, and pads 108 for the cup portions 102*a*, 102*b*. Shoulder straps 106*a*, 106*b* may also be provided such that shoulder strap 106*a* connects between cup portion 102*a* and side wing panel 104*a* and shoulder strap 106*b* connects between cup portion 102*b* and side wing panel 104*b*. The pads 108 are formed of a sustainable material that provides both cushioning and support for a wearer's breasts. The remainder of the bra garment 100 may be formed of recycled materials and/or sustainable materials. As such, the entirety or substantially the entirety of the bra garment 100 can be formed of only sustaining and recycled materials.

The sustainable material in accordance with the present disclosure is a biobased material that is non-toxic to the wearer and may also be devoid of fossil-fuel-based foam material and the like. The sustainable material used to form the pads 108, for example, can have hardness and density values sufficient to provide both cushioning and support to the wearer. And the sustainable material for the bra garment 100 can be manufactured by a sustainable and environment-friendly process.

The sustainable material in accordance with the present disclosure is one that is ecological, friendly, climate-friendly, green, environmental, environmentally-sound, fuel-efficient, energy-efficient, non-polluting, organic, and energy-saving. The sustainable material is a material that can be viable, continuous, continual, feasible, unceasing, livable, supportable, imperishable, unending, renewable, and green. A sustainable material is produced based on available resources to meet current needs while ensuring that adequate resources are available for future generations. In an example, the sustainable material can be a sugar cane or corn-based polymer. Also, biodegradable additives can be added to the sugar cane or corn-based polymer.

The cup portions 102*a* and 102*b* and the side wing panels 104*a* and 104*b* may be formed of a recycled material, such as a recycled fabric. A recycled material in accordance with the present disclosure is one that is waste converted into usable material. Recycled fabrics are waste products or fabrics and textiles that can be sorted, graded and reused again to make recycled fabrics, such synthetic fibers like polyester, nylon, and the like.

Figure 5:
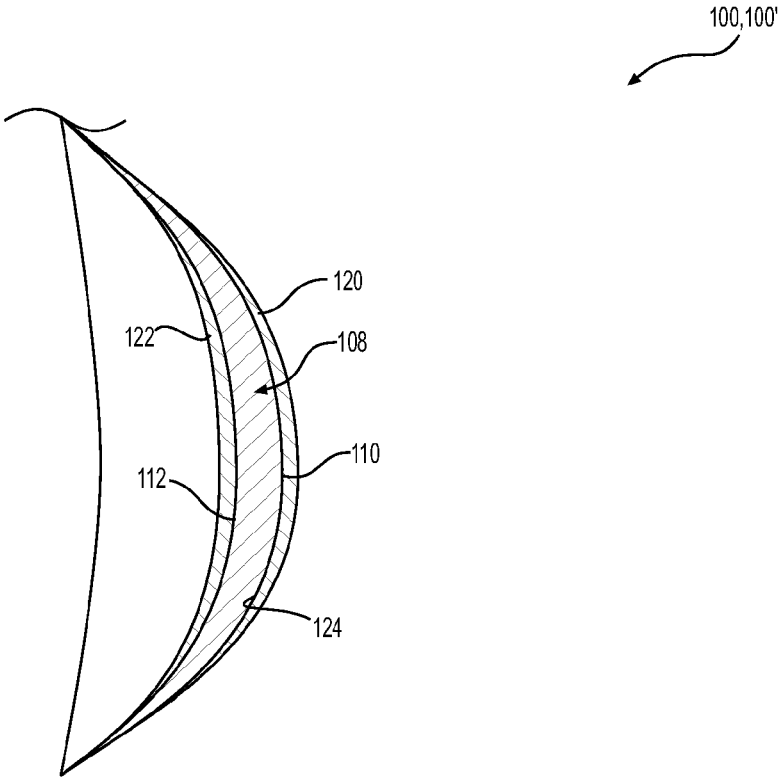
FIG. 5 is an enlarged partial cross-sectional view of a cup of the sustainable bra garment according to the present disclosure.

Each of the cup portions 102*a*, 102*b* of the bra garment 100 has an outer piece 120 and an inner piece 122 that can be attached, such as by sewing, to one another at respective perimeters thereof forming a pad receiving area 124 therebetween in which respective pads 108 are contained, as seen in FIG. 5. The outer piece 120 may have a generally convex shape selected from a number of available breast cup sizes. The inner piece may have a generally concave shape selected from a number of available cup sizes. The outer and inner pieces 120 and 122 are formed of one or more flexible materials. In an example, the outer piece can be formed of nylon or recycled nylon and the inner piece can be formed of polyester or recycled polyester. The polyester can be brushed for added softness against the wearer's skin.

Each of the pads 108 has front and back surfaces 110 and 112 that correspond to the outer and inner pieces 120 and 122, respectively, of the cup portions 102*a*, 102*b*. The front surface 110 of each pad 108 has a generally convex shape and the back surface 112 of each pad 108 has a generally concave shape, as best seen in FIG. 5. The size of the pad 108 can be any breast cup size and generally corresponds to the size of the outer and inner pieces 120 and 122 of the cup portions 102*a*, 120*b*.

Each of the pads 108 is formed of a sustainable material that is a bio-based or Green EVA polymer material with hardness and density values that provide both cushioning and support to breasts of a wearer of the sustainable bra garment, and that is non-toxic to the wearer. For example, the sustainable material of the pads 108 may be comprised of between about 60 to 85% sugar cane polymer. This ratio of the sustainable material provides the desired flexibility to the pads 108 as well as providing comfort and cushioning and sufficient support to the wearer.

Figure 6:
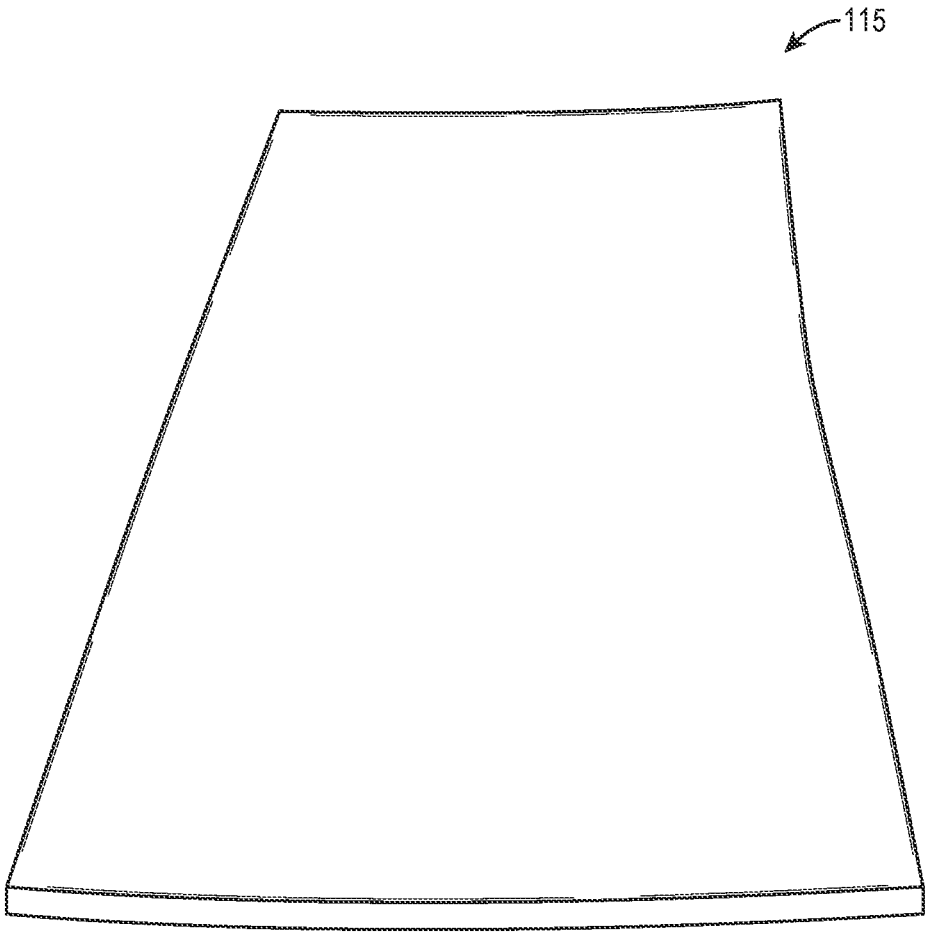
FIG. 6 is a front perspective view of a bio-based EVA foam sheet used for forming one or more pads made in accordance with the present disclosure.

In an example of a preferred embodiment, the pads 108 are formed only of the sustainable material that is polymerized using between 60% to 85% bio-based EVA (eg. A sugar cane-based polymer). The bio-based EVA is polymerized by combining said sustainable substance (in the form of sugarcane ethanol) with an initiator, such as a hydrogen peroxide (or bis peroxide) and a blowing (or foaming) agent, such as an azodicarbonimide, as well as other chemicals and additives known in the art, such as a titianium dioxide which may be used as a coloring pigment. The method of the present invention includes heating the bio-based EVA mixture from room temperature to about 125 degrees Celsius (about 260° F.) to create a melt mixture that resembles the consistency of a dough. Such bio-based EVA material is then compressed using a pass-through pressing belt to form a substantially flat sheet. The volumetric shape of the substantially flat bio-based EVA sheet is then expanded through a two-step heating process comprising: 1) heating said sheet to about 130 degrees Celsius (about 265° F.) for about 25 minutes to obtain a volumetric expansion of about 90%, and 2) re-heating said sheet to about 175 degrees Celsius (about 350° F.) for about 45 minutes to obtain a second volumetric expansion of about 200% to form a bio-based EVA foam sheet. An example of a resulting bio-based EVA foam sheet 115 is shown in FIG. 6, which can be used as material for forming one or more pads 108.

Figure 7:
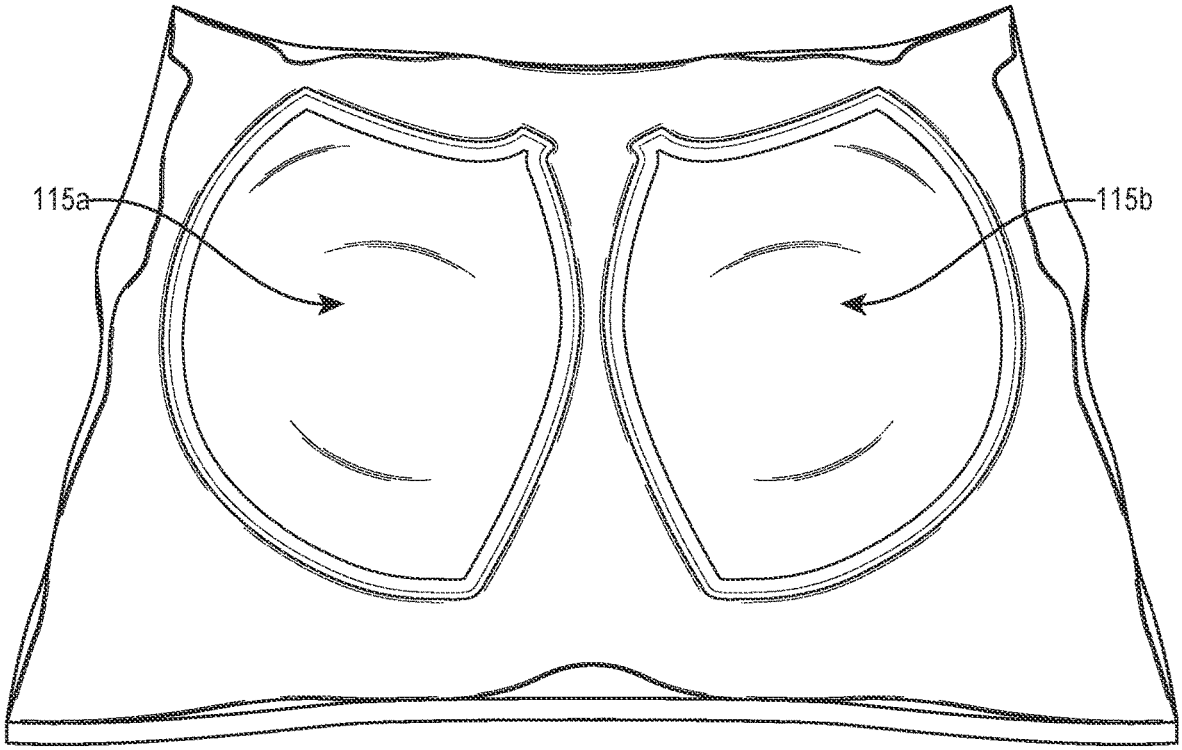
FIG. 7 is a front perspective view of pad portions partially formed from a bio-based EVA foam sheet, as illustrated in FIG. 6, made in accordance with the present disclosure.

The bio-based EVA foam sheet 115 is then formed into partial pad portions 115*a* and 115*b* by a molding method comprising: 1) heating a portion of said bio-based polymer foam sheet within a mold to about 160° C. (320° F.) for about 2 minutes, and 2) cooling said bio-based polymer foam sheet within said mold to about 10° C. (50° F.) for about 2 minutes; such that each said partial pad portion (115*a* and 115*b*) is formed within said mold into a shape having an inner surface substantially concave in shape and an outer surface substantially convex in shape and resulting in pad portions having preferred Asker hardness values of about 15 to about 25 on an Asker C scale. Examples of partially formed pad portions 115*a* and 115*b* are shown in process in FIG. 7 after forming of the pad cup portions using the above preferred molding methods.

Figure 8:
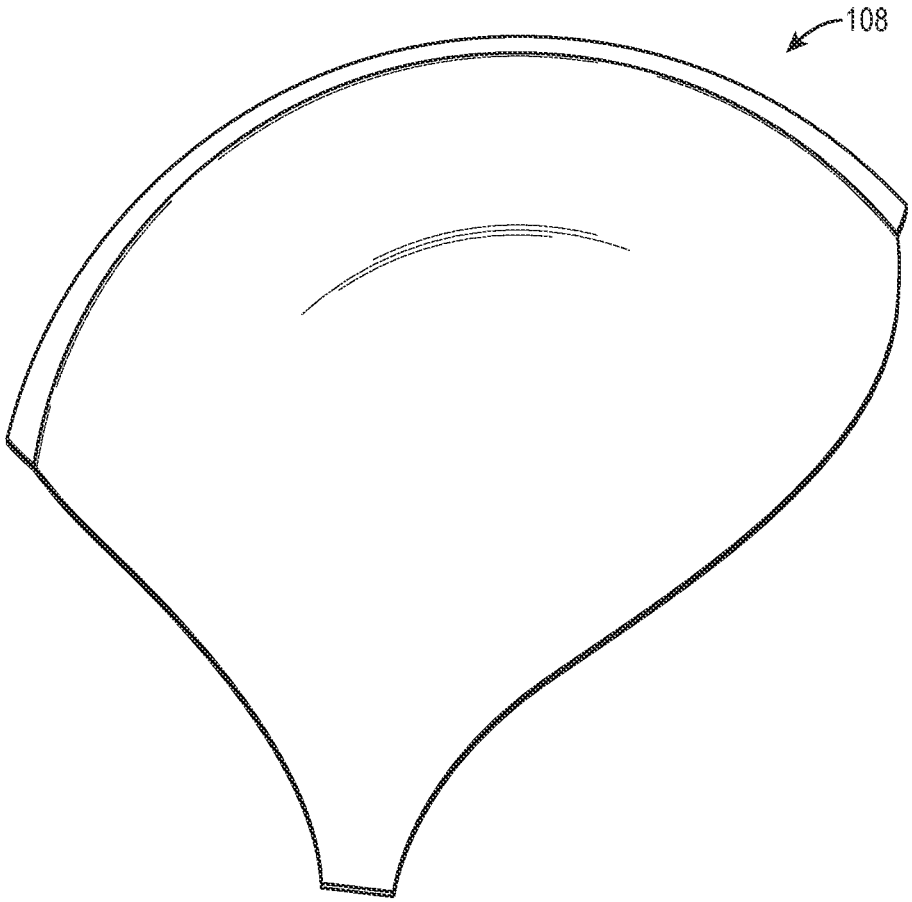
FIG. 8 is a front or elevational view of a finished pad made according to the present disclosure.

An example of a finished pad portion 108 made in accordance with the above processing methods is shown in FIG. 8. The above-preferred processing methods can yield pad portions having various cup sizes. Several such pad portion samples were subjected to a SATRA test method to assess a preferred range of pad material hardness properties. The material hardness of each sample ranging from cup sizes of 32A to 40DD was determined at various surface points by subjecting samples to a SATRA TM205:2016 test method using a durometer having an Asker C scale to measure the material hardness. It was determined after such hardness testing that a range of Asker C hardness values of between about 17 to about 22 resulted in preferred material hardness values to provide both appropriate cushioning and sufficient support for the breasts of a wearer of a sustainable bra garment or other garment in which such pads 108 are incorporated.

The front surface 110 of each pad 108 may also be laminated to assist with application of the outer piece 120 of the cup portions 102*a*, 120*b*. The back surface 112 of each pad 108 may be devoid of any lamination. Alternatively, each pad 108 can be devoid of any lamination altogether, i.e. on either the front or back surface 110 and 112 thereof.

Each of the side wing panels 104*a*, 104*b* is connected to an outer edge of a respective cup portion 102*a*, 102*b*. The side wing panels 104*a*, 104*b* can be formed of one or more fabrics, such as nylon, recycled nylon and the like. The side wing panels 104*a*, 104*b* can be made of the same or different recycled fabric as that of the cup portions 102*a*, 102*b*. Also, recycled yarns may be used for sewing the perimeters of any of the portions or panels of the bra garment 100, such as the perimeters 109 around the side wing panel 104*a*, 104*b*. The free ends of the side wings panels 104*a*, 104*b* include corresponding clasp elements 130 and 132, respectively, such as hook and eye elements, for clasping the free ends together in a conventional manner. The clasp elements 130 and 132 may be formed of recycled materials, such as recycled metal for the hook, and fabric or yarn for the eye.

The shoulder straps 106*a*, 106*b* may be formed of recycled materials, such as a recycled elastic material , such as recycled yarns and the like, to provide flexibility and comfort to the wearer. Each shoulder strap 106*a* and 106*b* may be adjustable using adjustable elements such as corresponding ring and hook members 134 and 136, which function as is known in the art. The ring and hook members 134 and 136 may be formed of a sustainable material, such as a sugar cane polymer. The sugar cane polymer of the ring and hook members 134 and 136 would be harder and more rigid that the sugar cane polymer which forms the pads 108. That is, the sugar cane polymer of the ring and hook members 134 and 136 have a sufficient hardness value and rigidity to couple to the shoulder straps 106*a*, and 106*b* to allow adjustment thereof.

Figure 1:
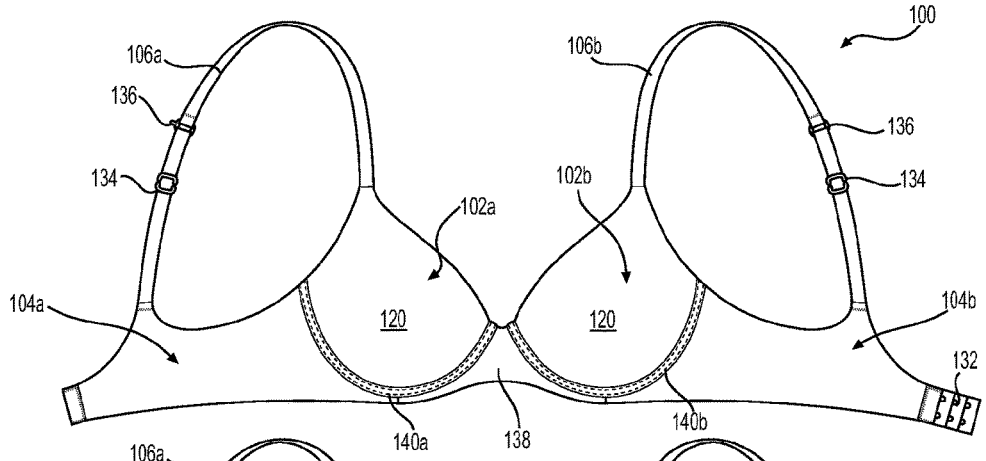
FIG. 1 is a front or outside elevational view of an exemplary sustainable bra garment, according to present disclosure.
Figure 2:
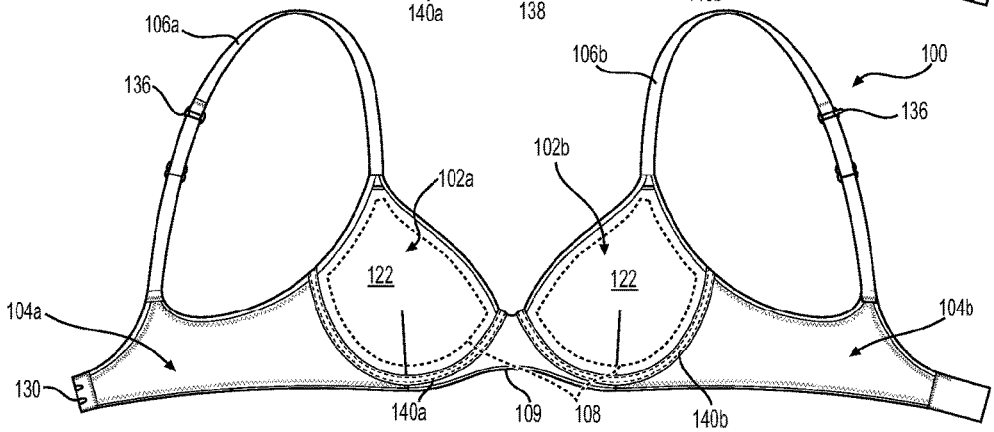
FIG. 2 is a rear or inside elevational view of the sustainable bra garment illustrated in FIG. 1.
Figure 3:
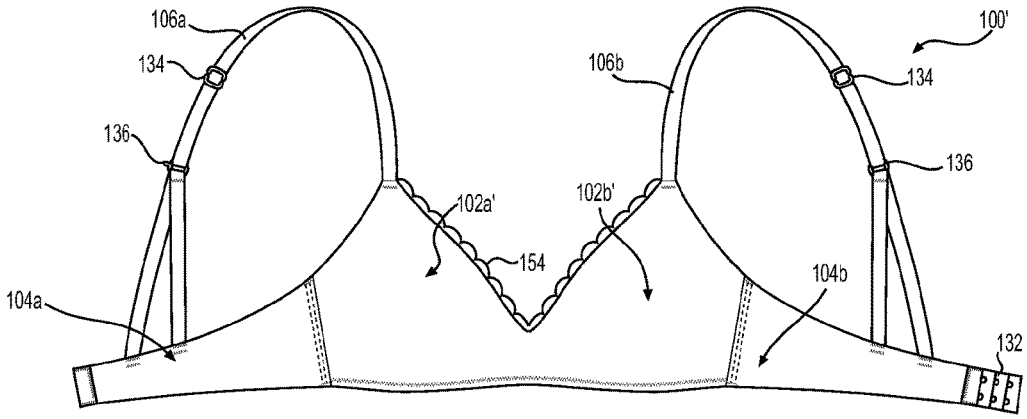
FIG. 3 is a front or outside elevational view of another exemplary sustainable bra garment, according to present disclosure.
Figure 4:
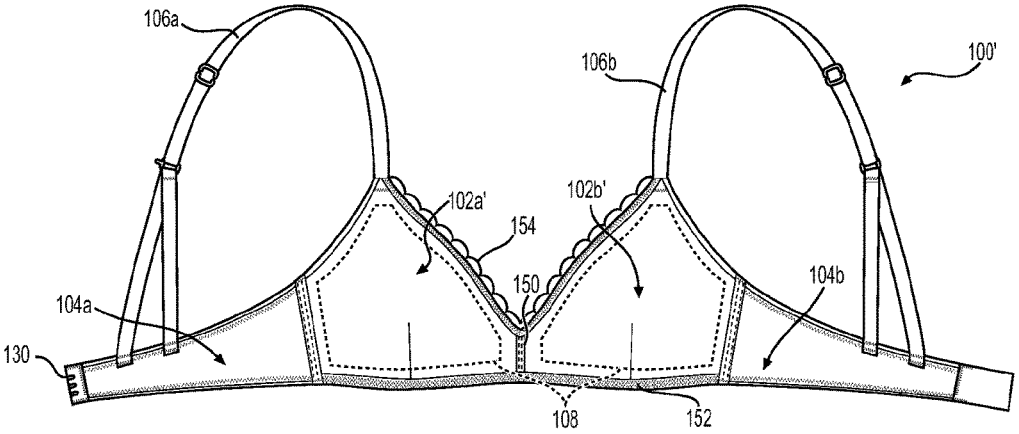
FIG. 4 is a rear or inside elevational view of the sustainable bra garment illustrated in FIG. 3.

The bra garment 100 may include an underwire, as seen in FIGS. 1 and 2, or the bra garment 100' may not have underwire, as seen in FIGS. 3 and 4. The bra garment 100 has an underwire channels 140*a*, 140*b* at the bottom of supports 102*a*, 102*b*, respectively. The underwire channels 140*a*, 104*b* may be formed of recycled fabrics, such as recycled yarns, and are sized to receive a conventional underwire. A bridge panel 138 extends between the underwire channels 140*a*, 140*b* to join the cup portions 102*a*, 102*b*. The bridge panel 138 can be formed of a recycled material, such as recycled nylon.

The bra garment 100' as seen in FIGS. 3 and 4, is substantially the same as the bra garment 100 of FIGS. 1 and 2, except that it does not have an underwire or underwire channels. The cup portions 102*a*', 102*b*' of the bra garment 100' are the same as cup portion 102*a*, 102*b*, except that the cup portions 102*a*, 102*b*' are sewn together, using recycled yarn for example, at a center line 150 and a bottom line 152, as best seen in FIG. 4. An optional lace trim 154 may be provide at the top of the cup portions 102*a*', 120*b*'. The lace trim 154 can be formed of a recycled material, such as recycled yarn and the like.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

The following definitions and terms are used in this disclosure:

EVA: As used in this disclosure, "EVA" is an acronym known and used in the art as a reference to "ethylene-vinyl-acetate", an elastic petroleum-based polymer that can be used to produce materials and products with a rubber-like softness and flexibility.

Green or Bio-based EVA: As used in this disclosure, "Green EVA" or "Bio-based EVA" is used to describe a carbon negative material made substantially from sugarcane (sugarcane ethanol) and used as an alternative and/or substitute for a petroleum-based polymer. Existing bio-based EVA materials are available commercially and are supplied by Braskem as an EVA resin. Preferred resins are identified as EVA Evance SVT 2145 and SVT 2180, which are typically in the form of foam sheets for use in the soles of footwear products, or in toys and furniture.

Hydrogen peroxide or bis (triflourmethyl) peroxide: As used in this disclosure, "hydrogen peroxide" or "bis peroxide" is used to describe a chemical used as an initiator (or catalyst) for the polymerization of unsaturated ethylene-like molecules for the production of stable polymeric materials, including as an initiator for Bio-based EVA materials.

Blowing or Foaming Agent: As used in this disclosure, a "blowing agent" or "foaming agent" is used to describe chemical compositions used in state-of-the-art polymerization processes, typically an azodicarbonimide, capable of producing a cellular structure through a foaming process to reduce density and increase relative stiffness of a base polymer.

Titanium dioxide or titanium IV oxide [TiO2]—As used in this disclosure, "titanium dioxide" or "titanium IV oxide" is used to describe a substance typically used as a pigment (also known as "titanium white") for paints and polymers.

Asker Hardness—As used in this disclosure, "Asker Hardness" is used to describe the measure of hardness of a given material (or how resistant it will be to permanent indentation)—measured by the depth of indentation that is created on the material with a specified force. The measuring instrument typically used is known as a durometer, and different respective scales for measuring hardness (such as Asker, Shore, Rockwell hardness scales)) are known in the art. Accordingly, different hardness scales are used for measuring the solidity of different materials with varying properties, like rubbers, polymers and elastomers. The most commonly used scales for measuring the hardness of rubber materials are the Asker C and Shore 00 or A scales for softer materials and the Shore D scale for harder materials. The Asker C scale is generally used for measuring hardness of more flexible foam or rubber materials.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. A sustainable bra garment, comprising:

first and second cup portions that are formed of one or more recycled flexible materials;

first and second side wing panels extending from the first and second cup portions, respectively, the first and second side wing panels being formed of one or more recycled flexible materials; and first and second cushioning support pads configured to be coupled with the first and second cup portions, respectively, each of said pads having front and back surfaces, the front surface of each pad having a generally convex shape and the back surface of each pad having a generally concave shape;

each of said pads being formed of a bio-based polymeric foam material that has hardness and density values that provide both cushioning and support to breasts of a wearer of the sustainable bra garment;

said bio-based polymeric foam material comprising at least about 60-85% sugar cane-based polymer;

said sugar cane-based polymer combined with at least;
a peroxide-based initiator, and
a foaming agent;
said sugar cane-based polymer, peroxide-based initiator and foaming agent mixture formed into a substantially flat sheet by methods comprising;
the addition of heat to about 125° C. to form a liquid melt mixture; and
compressing said liquid melt mixture in a pass through pressing belt to form a substantially flat sheet;
expanding the volume of said substantially flat sheet by a two-step heating method comprising,
heating said substantially flat sheet to about 130° C. for about 25 minutes to obtain an expansion of about 90% of said substantially flat sheet, and
re-heating said substantially flat sheet to about 175° C. for about 45 minutes to achieve a second expansion of about 200%;
whereby a substantially flat bio-based polymer foam sheet is formed, said bio-based polymer foam sheet being shaped into pad portions by a molding method comprising;
heating said bio-based polymer foam sheet within a mold to about 160° C. for about 2 minutes, and
cooling said bio-based polymer foam sheet within said mold to about 10° C. for about 2 minutes;
each said pad portion formed within said mold into a shape having an inner surface substantially concave in shape and an outer surface substantially convex in shape;
said bio-based polymeric foam material having, an Asker C hardness value of about 15 to about 25.

2. The sustainable bra garment of claim 1, wherein the sustainable material is a biobased material that is non-toxic to the wearer and is devoid of any petroleum-based foam material.

3. The sustainable bra garment of claim 1, wherein each pad is devoid of a lamination or glue layer on at least the back surface thereof.

4. The sustainable bra garment of claim 1, wherein the one or more recycled materials of the first and second cup portions and the first and second side wing panels are formed of one or more recycled fabrics.

5. The sustainable bra garment of claim 4, wherein the first and second cup portions and the first and second side wing panels are formed of the same recycled fabric.

6. The sustainable bra garment of claim 1, further comprising elastic shoulder straps attached between the first cup portion and the first side wing panel and between the second cup portion and the second side wing panel, respectively, and the elastic shoulder straps are formed of recycled materials.

7. The sustainable bra garment of claim 6, wherein each of the shoulder straps include an adjustable element for adjusting the length of the shoulder straps, the adjustable element being formed of a sustainable material that has a hardness value that is greater than the hardness value of the sustainable material of the pads.

8. The sustainable bra garment of claim 1, wherein each of the first and second cup portions has an underwire channel.

9. The sustainable bra garment of claim 1, further comprising a bridge panel that joins the first and second cup portions, the bridge panel is formed of a recycled material.

10. The sustainable bra garment of claim 1, wherein the free ends of the first and second side wings panels include corresponding clasp elements for clasping the free ends together.

11. A sustainable cushioning support pad for use in a bra garment or other garment, comprising:
a pad portion formed of one or more bio-based polymeric foam materials, comprising at least about 60-85% sugar cane-based polymer;
said sugar cane-based polymer combined with at least;
a peroxide-based initiator, and
a foaming agent;
said sugar cane-based polymer, peroxide-based initiator and foaming agent mixture formed into a substantially flat sheet by methods comprising;
the addition of heat to about 125° C. to form a liquid melt mixture; and
compressing said liquid melt mixture in a pass through pressing belt to form a substantially flat sheet;
expanding the volume of said substantially flat sheet by a two-step heating method comprising,
heating said substantially flat sheet to about 130° C. for about 25 minutes to obtain an expansion of about 90% of said substantially flat sheet, and
re-heating said substantially flat sheet to about 175° C. for about 45 minutes to achieve a second expansion of about 200%;
whereby a substantially flat bio-based polymer foam sheet is formed, said bio-based polymer foam sheet being shaped into pad portions by a molding method comprising;
heating said bio-based polymer foam sheet within a mold to about 160° C. for about 2 minutes, and
cooling said bio-based polymer foam sheet within said mold to about 10° C. for about 2 minutes;
said pad portion formed within said mold into a shape having an inner surface substantially concave in shape and an outer surface substantially convex in shape;
said pad portion having an Asker C hardness value of about 15 to about 25.

12. A method for making cushioning support pads for use in a sustainable bra garment or other garment, comprising:
pad portions formed of one or more bio-based polymeric foam materials, comprising at least about 60-85% sugar cane-based polymer;
said sugar cane-based polymer combined with at least;
a peroxide-based initiator, and
a foaming agent;
said sugar cane-based polymer, peroxide-based initiator and foaming agent mixture formed into a substantially flat sheet by methods comprising;
the addition of heat to about 125° C. to form a liquid melt mixture; and
compressing said liquid melt mixture in a pass through pressing belt to form a substantially flat sheet;
expanding the volume of said substantially flat sheet by a two-step heating method comprising,
heating said substantially flat sheet to about 130° C. for about 25 minutes to obtain an expansion of about 90% of said substantially flat sheet, and
re-heating said substantially flat sheet to about 175° C. for about 45 minutes to achieve a second expansion of about 200%;
whereby a substantially flat bio-based polymer foam sheet is formed, said bio-based polymer foam sheet being shaped into pad portions by a molding method comprising;

heating said bio-based polymer foam sheet within a mold to about 160° C. for about 2 minutes, and cooling said bio-based polymer foam sheet within said mold to about 10° C. for about 2 minutes;

each said pad portion formed within said mold into a shape having an inner surface substantially concave in shape and an outer surface substantially convex in shape;

each said pad portion having an Asker C hardness value of about 15 to about 25.

* * * * *